US007748410B2

(12) United States Patent
Ono

(10) Patent No.: US 7,748,410 B2
(45) Date of Patent: Jul. 6, 2010

(54) FLUID HANDLING APPARATUS

(75) Inventor: Koichi Ono, Kawaguchi (JP)

(73) Assignee: Enplas Corporation, Saitama (JP)

( * ) Notice: Subject to any disclaimer, the term of this patent is extended or adjusted under 35 U.S.C. 154(b) by 644 days.

(21) Appl. No.: 11/710,167

(22) Filed: Feb. 23, 2007

(65) Prior Publication Data

US 2007/0199603 A1 Aug. 30, 2007

(30) Foreign Application Priority Data

Feb. 24, 2006 (JP) ..... 2006-047743

(51) Int. Cl.
*F15C 1/04* (2006.01)

(52) U.S. Cl. ..... 137/825; 137/833

(58) Field of Classification Search ..... 137/825, 137/833

See application file for complete search history.

(56) References Cited

U.S. PATENT DOCUMENTS 6,835,313 B2 * 12/2004 Sando et al. ..... 210/634
6,911,276 B2 * 6/2005 Extrand ..... 429/32
2004/0209047 A1 * 10/2004 Extrand et al. ..... 428/156
2005/0133101 A1 * 6/2005 Chung et al. ..... 137/833

FOREIGN PATENT DOCUMENTS

JP 2003-503715 1/2003
JP 2005-114433 4/2005

* cited by examiner

*Primary Examiner*—John Rivell
*Assistant Examiner*—Craig M Schneider
(74) *Attorney, Agent, or Firm*—Bachman & LaPointe, P.C.

(57) ABSTRACT

A first liquid fed into a first flow passage 6 of a fluid handling apparatus travels to the open end thereof on the side of a second flow passage 7 due to capillarity. The movement of the first liquid is uniformed on the cross section of the flow passage by the function of a capillarity promoting portion 220 or 230 of the bottom 21 of the first flow passage 6. Then, the movement of a second liquid fed into the second flow passage 7 is uniformed on the cross section of the flow passage by the function of the capillarity promoting portion 220 or 230 of the bottom 21 of the second flow passage 7. Thus, the movement of the front end of the second liquid is substantially uniformed to surely extrude gas from the second flow passage 7 to the outside via a fourth flow passage 10.

6 Claims, 9 Drawing Sheets

FLUID HANDLING APPARATUS

BACKGROUND OF THE INVENTION

1. Field of the Invention

The present invention generally relates to a fluid handling apparatus. More specifically, the invention relates to a fluid handling apparatus for forming a liquid-liquid interface level in a communication portion in which a flow passage is communicated with another flow passage (i.e., in a junction between flow passages).

2. Description of the Prior Art

In recent years, there is known a technique wherein a micro flow passage (a fine flow passage) having a width and depth of about tens to two hundreds micrometers formed in a substrate of a glass or plastic is utilized for carrying out a chemical analysis, a chemical reaction, weighing or the like. A fluid handling apparatus having such a micro flow passage is called microchip. In particular, the fluid handling apparatus is called μ-TAS (Total Analytical System) if it is used for carrying out a chemical analysis, and it is called micro reactor if it is used for allowing a chemical reaction. Since the space of a microchip for carrying out a chemical analysis, a chemical reaction, weighting or the like is very small, the microchip has various advantages, such as the shortening of the time to transport diffuse molecules, and the precise temperature control and weighting.

As such fluid handling apparatuses, there are various apparatuses, each of which has a micro fluid passage having one of various shapes (see Japanese Patent Laid-Open No. 2005-114433 and Japanese Patent Unexamined Publication No. 2003-503715 (National Publication of Translated Version of PCT/US00/18616)). For example, Japanese Patent Laid-Open No. 2005-114433 discloses a fluid handling apparatus capable of precisely metering and quantitatively analyzing a very small amount of sample, such as a protein or nucleic acid, which is required to be analyzed. In addition, Japanese Patent Unexamined Publication No. 2003-503715 discloses a technique for changing the flowability of fluid in capillary to improve the fluid carrying capacity (or the capacity to carry fluid) by devising the surface structure of a flow passage formed in a fluid handling apparatus for carrying out the sampling and purification of a biosubstance, addition and detection of a reagent, and so fourth.

However, in the fluid handling apparatus disclosed in Japanese Patent Laid-Open No. 2005-114433, it is required to operate positive and negative pressures by means of a gas control device in order to exhaust gas from the apparatus, so that there are problems in that the operation of the apparatus is complicated and that the structure of the whole apparatus including the gas control device is complicated and enlarged.

The fluid handling apparatus disclosed in Japanese Patent Unexamined Publication No. 2003-503715 can enhance the flowability of fluid in capillary, but it is not designed to prevent a gas, such as air, existing in the flow passage from remaining therein as bubbles. Therefore, in such a fluid handling apparatus, there are some cases where the bubbles remaining in the flow passage have a bad influence on a chemical analysis, a chemical reaction or the like.

SUMMARY OF THE INVENTION

It is therefore an object of the present invention to eliminate the aforementioned problems and to provide a fluid handling apparatus capable of controlling the flow of a fluid in a flow passage so that it is difficult for bubbles to remain in the flow passage.

In order to accomplish the aforementioned and other objects, according to one aspect of the present invention, a fluid handling apparatus comprises: a flow passage for allowing a fluid to move therein due to capillarity; a communication portion for establishing a fluid communication between the flow passage and an external environment; a fluid movement suppressing portion for suppressing the movement of the fluid in the flow passage due to capillarity, at least a part of the fluid movement suppressing portion being formed upstream of the communication portion; and a capillarity promoting portion for allowing the uniform movement of the fluid in the flow passage, at least a part of the capillarity promoting portion being formed upstream of the fluid movement suppressing portion, wherein a traveling end face of the fluid is controlled in the capillarity promoting portion so as to approach a plane parallel to a perpendicular plane to a traveling direction of the fluid, and thereafter, the traveling end face of the fluid is controlled in the fluid movement suppressing portion so as to be inclined in forward or backward with respect to the plane parallel to the perpendicular plane.

In this fluid handling apparatus, the capillarity promoting portion preferably has one or a plurality of fine grooves or fine protruding portions which extend in the traveling direction of the fluid. The fluid movement suppressing portion is preferably a flatter surface than the capillarity promoting portion. Alternatively, the fluid movement suppressing portion may be a convex or concave portion formed so as to suppress capillarity acting on the fluid traveling in the flow passage.

In a fluid handling apparatus according to the present invention, a capillarity promoting portion allows the uniform movement of a fluid (liquid), so that the traveling end face (the front end face) of the fluid flows in a flow passage while driving a gas in the downstream flow direction, and thereafter, a fluid movement suppressing portion formed so as to suppress the movement of the fluid due to capillarity allows the gas to reach a communication portion, in which the interior of the fluid passage is communicated with the external environment, before the arrival of the liquid to exhaust the gas to the external environment. Therefore, it is possible to prevent the gas from remaining in the flow passage.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of a fluid handling apparatus according to the present invention will be described below in detail.

First Preferred Embodiment

Figure 1A:
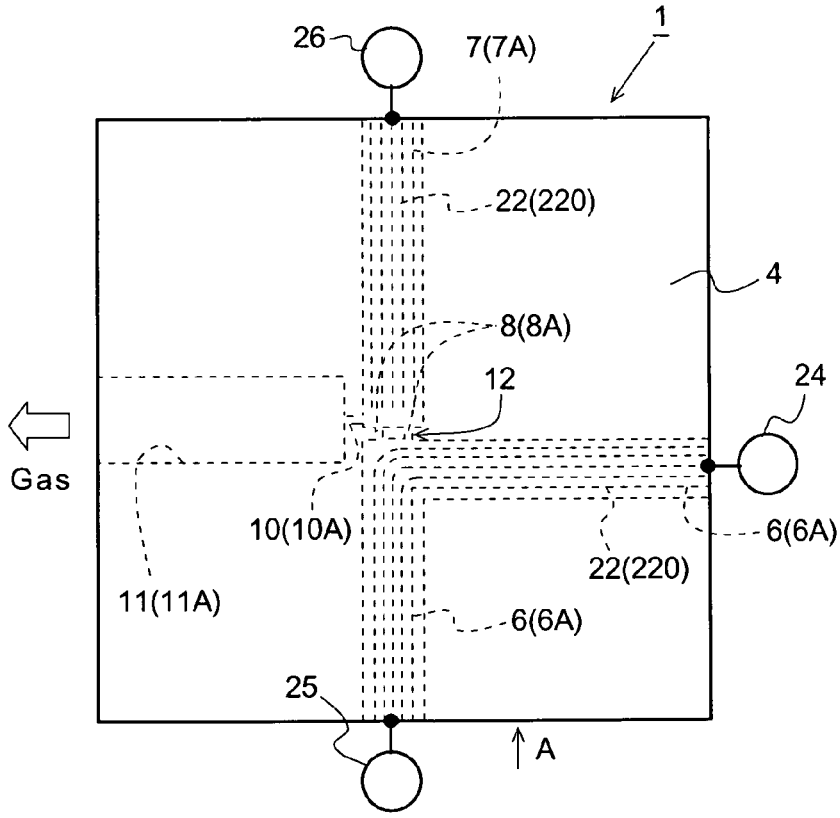
FIG. 1A is a plan view of the first preferred embodiment of a fluid handling apparatus according to the present invention.
Figure 1B:
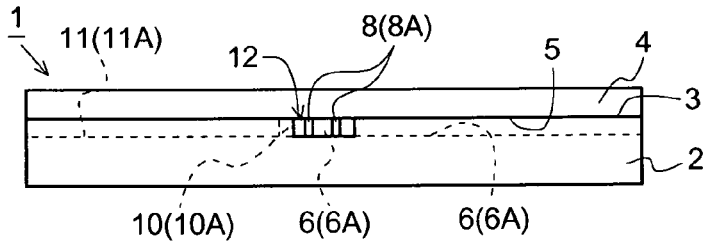
FIG. 1B is a side view of the fluid handling apparatus of FIG. 1A on the front side thereof (which is viewed in the direction of arrow A of FIG. 1A)

FIG. 1A is a plan view of the first preferred embodiment of a fluid handling apparatus 1 according to the present invention, and FIG. 1B is a side view of the fluid handling apparatus 1 of FIG. 1A, which is viewed in the direction of arrow A of FIG. 1A.

Figure 2:
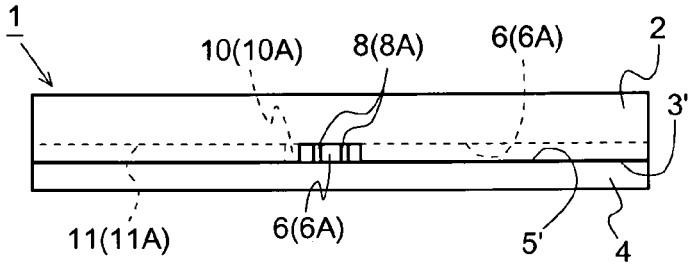
FIG. 2 is a side view showing a modified example of the first preferred embodiment of a fluid handling apparatus according to the present invention.

As shown in FIGS. 1A and 1B, the fluid handling apparatus 1 in this preferred embodiment comprises a first sheet-like member 2 having a rectangular planar shape, and a second sheet-like member 4 stacked on the first member 2 so as to cover the whole surface 3 thereof. The first member 2 and second member 4 are made of any one of various resin materials, such as polymethyl methacrylate (PMMA), polycarbonate (PC) and ultraviolet curable resins, glasses and ceramics. The stacked surfaces (facing surfaces) of the first and second members 2 and 4 (the surface 3 of the first member 2 and the reverse 5 of the second member 4) are smoothed flat surfaces having a good adhesion. The first member 2 is stacked on the second member 4 so that the surface 3 of the first member 2 closely contacts the reverse 5 of the second member 4. In this state, the first member 2 is detachably or undetachably fixed to the second member 4 by means of an adhesion, fasteners, clips or the like. While the first and second members 2 and 4 have been sheet-like members in this preferred embodiment, the present invention should not be limited thereto, but they may be cubic block-shaped members. Alternatively, the second member 4 to be stacked on the surface 3 of the first member 2 may be a film-like member. In the fluid handling apparatus 1 shown in FIGS. 1A and 1B, the second member 4 has been arranged on the upper face of the first member 2 for convenience, but the first member 2 may be arranged on the upper face of the second member 4 as shown in FIG. 2. In FIG. 2, the reverse 3' of the first member 2 is stacked on the surface 5' of the second member 4.

Figure 3A:
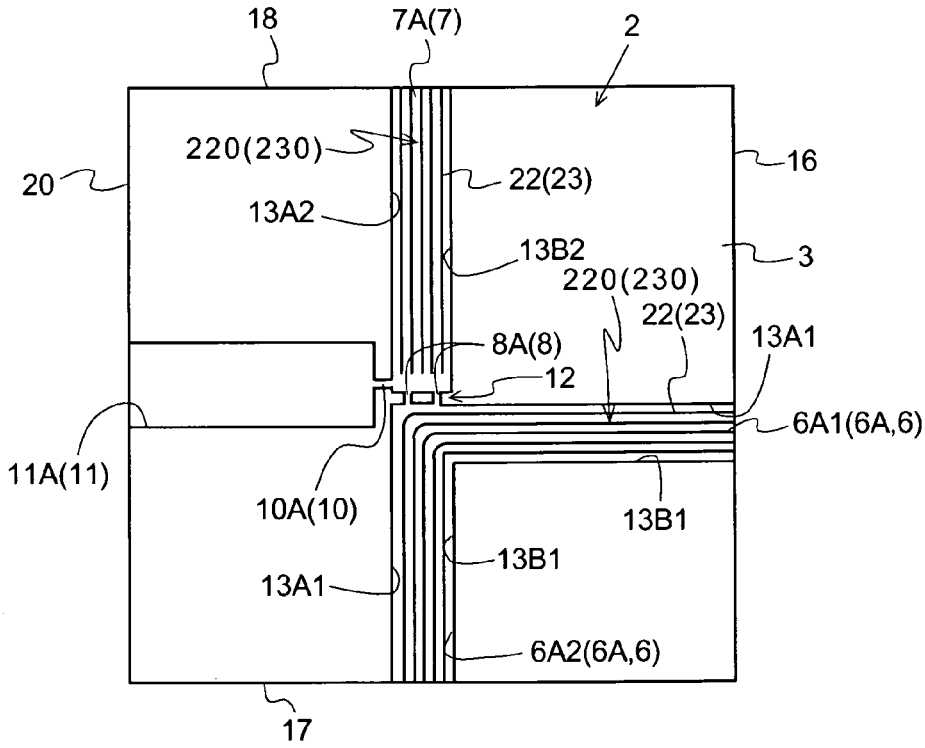
FIG. 3A is a plan view of a first member of the first preferred embodiment of a fluid handling apparatus according to the present invention.

FIG. 3A is a plan view of the first member 2. As shown in FIG. 3A, the surface 3 of the first member 2 has a first groove 6A for a first flow passage 6, a second groove 7A for a second flow passage 7, a third groove 8A for a third flow passage 8 for establishing a communication between the first groove 6A and the second groove 7A, a fourth groove 10A for a fourth flow passage 10 for establishing a communication between an external communication groove 11A and an end portion of the second groove 7A on the side of the third grooves 8A, and the external communication groove 11A for an external environment communication passage 11 for establishing a communication between the second groove 7A and the external environment via the fourth groove 10A (see FIG. 1A).

Figure 3B:
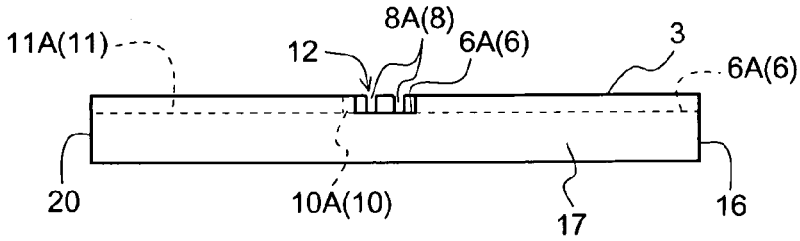
FIG. 3B is a side view of the first member of FIG. 3A.

As shown in FIG. 3A, the first groove 6A comprises a lateral groove portion 6A1 which linearly extends in lateral directions in the figure, and a longitudinal groove portion 6A2 which linearly extends downwards in vertical directions in the figure, the longitudinal groove portion 6A2 extending from the left end portion of the lateral groove portion 6A1 in the figure to be bent at right angles to the lateral groove portion 6A1. The second groove 7A linearly extends in vertical directions in the figure so as to be aligned with the longitudinal groove portion 6A2 of the first groove 6A. As shown in FIGS. 3A and 3B, the third groove 8A forms two communication portions 12 for establishing communications between the first groove 6A (the first flow passage 6) and the second groove 7A (the second flow passage 7) (see FIGS. 1A and 1B), each of the communication portions 12 having a smaller sectional area than that of the first groove 6A and second groove 7A (each of the communication portions 12 being so small as to abruptly decrease the width of each of the first groove 6A and second groove 7A), and the communication portions 12 being arranged in parallel so as to be perpendicular to the lateral groove portion 6A1 of the first groove 6A (to lateral directions in FIG. 3A). The fourth groove 10A has a smaller width than that of the second groove 7A and external communication groove 11A (the fourth groove 10A is so small as to abruptly decrease the width of the external communication groove 11A), and the fourth groove 10A is communicated with to the end portion of the second groove 7A (near the third groove 8A for establishing the communication between the first groove 6A and the second groove 7A in FIG. 3A). The first groove 6A, second groove 7A and external communication groove 11A are formed so that the shape of a cross section perpendicular to the flow direction of a fluid is rectangular (see FIGS. 1A, 1B, 3A and 3B).

Figure 4:
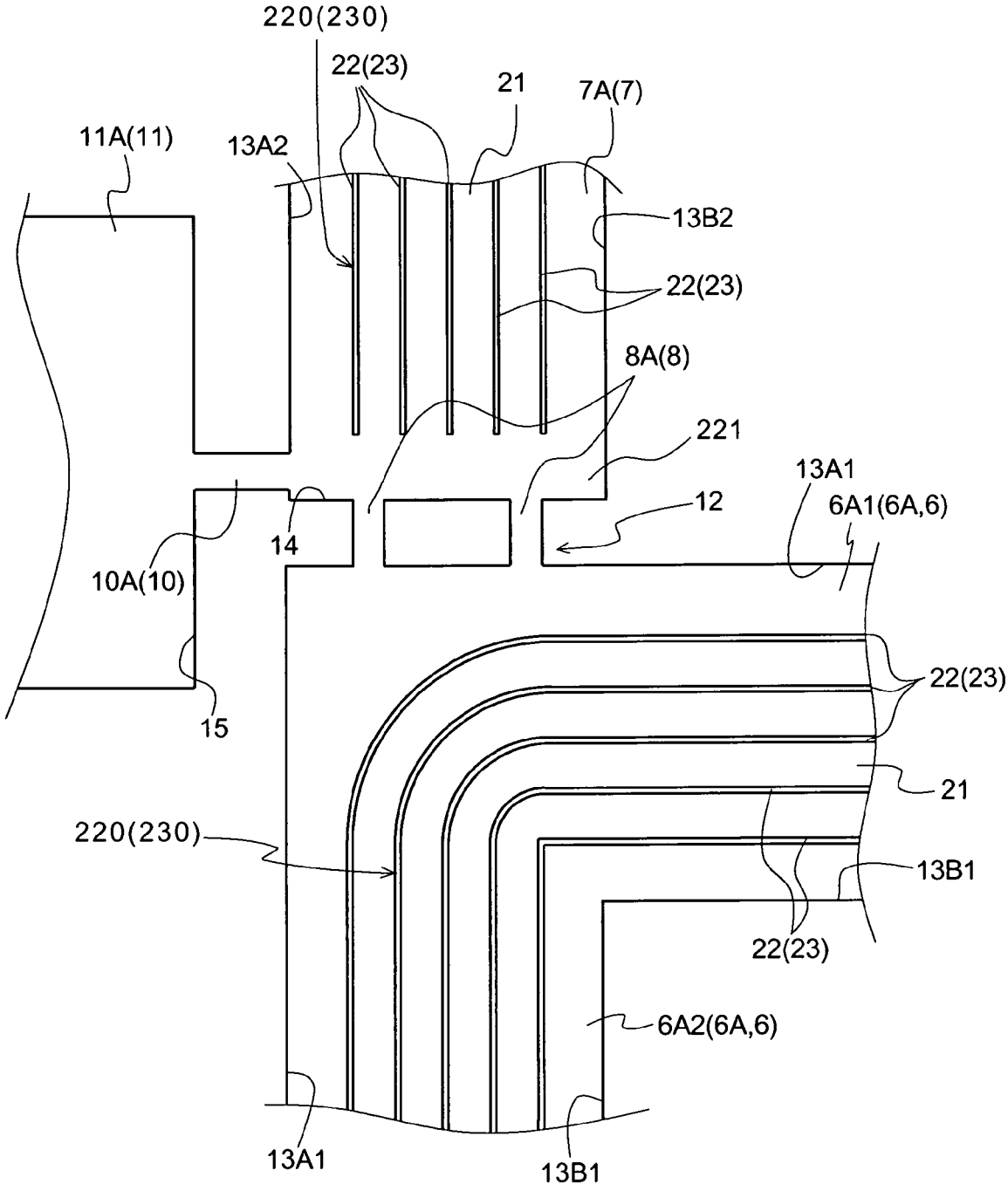
FIG. 4 is an enlarged plan view showing a part of the first member of FIG. 3A.

As shown in FIG. 4, the third groove 8A is open in the side face 13A1 of the first groove 6A and in the end portion 14 of the second groove 7A so as to be perpendicular thereto, so that the opening portion thereof forms a corner portion perpendicular to the side face 13A1 of the first groove 6A and to the end portion 14 of the second groove 7A. The fourth groove 10A is open in the end portion 15 of the external communication groove 11A so as to be perpendicular thereto, so that the opening portion thereof on the side of the external communication portion 11A forms a corner portion perpendicular to the end portion 15 of the external communication groove 11A.

As shown in FIG. 3A, the planar shape of the first groove 6A has L-shaped, and the first groove 6A is open in the surface 3 of the first member 2. One end of the first groove 6A is open in the right side face 16 of the first member 2, and the other end thereof is open in the lower side face 17 of the first member 2 (see FIG. 3B). As shown in FIG. 3A, the second groove 7A is open in the surface 3 of the first member 2, and is open in the upper side face 18 of the first member 2. As shown in FIG. 3A, the external communication groove 11A is open in the surface 3 of the first member 2, and is open in the left side face 20 of the first member 2 (see FIG. 3B). As shown in FIGS. 3A and 3B, the third groove 8A is open in the surface 3 of the first member 2, and is communicated with the first groove 6A and second groove 7A. The third groove 8A has a rectangular cross section, and has the same depth as that of the first groove 6A and second groove 7A. As shown in FIGS. 3A and 3B, the fourth groove 10A is open in the surface 3 of the first member 2, and is communicated with the second groove 7A and external communication groove 11A. The fourth groove 10A has a rectangular cross section, and has the same depth as that of the second groove 7A and external communication groove 11A. Furthermore, in this preferred embodiment as shown in FIGS. 3A and 3B, the cross-sectional area of the first groove 6A is substantially the same as that of the second groove 7A, and the cross-sectional area of the third groove 8A is substantially the same as that of the fourth groove 10A, but the present invention should not be limited thereto. For example, the cross-sectional area of the first groove 6A may be different from that of the second groove 7A, or the cross-sectional area of the third groove 8A may be different from that of the fourth groove 10A. Alternatively, the second groove 7A may be communicated with the external environment via the fourth groove 10A without providing the external communication groove 11A.

Figure 3C:
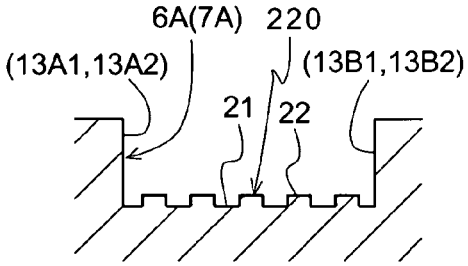
FIG. 3C is an enlarged sectional view showing first and second grooves of the first member of FIG. 3B.

As shown in FIGS. 3A through 3C and 4, the bottom 21 of each of the first groove 6A and second groove 7A of the first member 2 with this construction has a plurality of micro protrusions (fine protruding portions or fine ribs) 22 (five micro protrusions 22 in this preferred embodiment), which extend in longitudinal directions of each of the grooves 6A and 7A (in directions perpendicular to the width directions of the grooves 6A and 7A (see FIG. 1A). As shown in FIG. 3C, the cross-sectional area of each of the micro protrusions 22 is far smaller than that of the first groove 6A and second groove 7A. As shown in FIG. 4, the other micro protrusions 22 of the first groove 6A than the innermost micro protrusion 22 are formed so as to be circular-arc-shaped (quarter circular) in a connecting portion in which the lateral groove portion 6A1 is connected to the longitudinal groove portion 6A2. The size of the circular arc of each of the other micro protrusions 22 is larger in the outer portion of the connecting portion in which the lateral groove portion 6A1 is connected to the longitudinal groove direction 6A2, so that fluid can smoothly flow in the first groove 6A. The micro protrusions 22 of the first groove 6A and second groove 7A are apart from the end portion of the third groove 8A so as to fulfill the function (liquid stop function) of the third groove 8A. The plurality of micro protrusions 22 form a capillarity promoting portion 220. As shown in FIGS. 1A, 3A and 4, the lower end of the capillarity promoting portion 220 of the second groove 7A in the figures (the downstream end in the flow direction of the fluid) is arranged above the opening portion (communication portion) of the fourth groove 10A on the side of the second groove 7A in the figures (the upstream end in the flow direction of the fluid). The bottom (flow passage wall surface) 21 in the region between the communication portion 12 and the lower end of the capillarity promoting portion 220 of the second groove 7A in the figures is a flat surface 221, which is flatter than the capillarity promoting portion 220, to form a fluid movement suppressing portion which has the function of suppressing the flow of liquid in the downstream end portion of the second flow passage 7 formed by the second groove 7A. Furthermore, it is not always required to form the micro protrusions 22 in the corner portion of the first groove 6A (in the portion in which the lateral groove portion 6A1 is connected to the longitudinal groove portion 6A2).

Figure 3D:
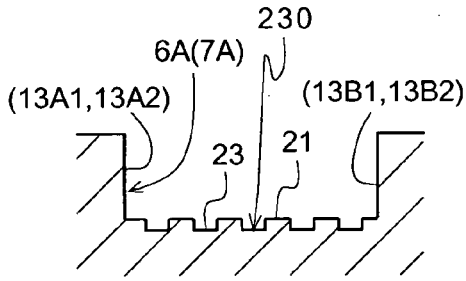
FIG. 3D is an enlarged sectional view showing a modified example of first and second grooves of FIG. 3C.

The shape of the cross section of each of the micro protrusions 22 (in the width directions of the groove) is rectangular as shown in FIG. 3C, but the present invention should not be limited thereto. For example, the shape of the cross section of each of the micro protrusions 22 may be triangular, trapezoidal or circular-arc (semicircular). As shown in FIG. 3D, micro grooves (fine grooves) 23 may be formed in place of the micro protrusions 22. The micro grooves 23 shown in FIG. 3D are formed in the bottom 21 of each of the first groove 6A and second groove 7A similarly to the micro protrusions 22. The plurality of micro protrusions 22 shown in FIG. 3C or the plurality of micro grooves 23 shown in FIG. 3D are arranged in regular intervals in the width directions of the first grooves 6A and second grooves 7A, respectively. Furthermore, the plurality of micro grooves 23 form a capillarity promoting portion 230.

The second member 4 is stacked on the surface 3 of the above described first member 2 to close the openings of the first through fifth grooves 6A, 7A, 8A and 10A and external communication groove 11A on the side of the surface 3 of the first member 2 to form the first through fourth flow passages 6 through 8, 10 and external environment communication passage 11.

Each of the first through fourth flow passages 6 through 8 and 11 is formed so as to have a cross-sectional area and flow passage surface properties for allowing a liquid to move in the flow passage due to capillarity (in view of an affinity between the flow passage and the liquid).

As shown in FIG. 1A, one end (right end in the figure) of the first flow passage 6 is connected to a first port 24 or flow passage (not shown) for feeding a first liquid. The other end (lower end in the figure) of the first flow passage 6 is connected to a second port 25 or flow passage (not shown) for exhausting gas from the interior of the flow passage to the outside. The upper end of the second flow passage 7 in the figure is connected to a third port 26 or flow passage (not shown) for feeding a second liquid. The external environment communication passage 11 establishes a communication between the second flow passage 7 and the external environment.

Figure 5:
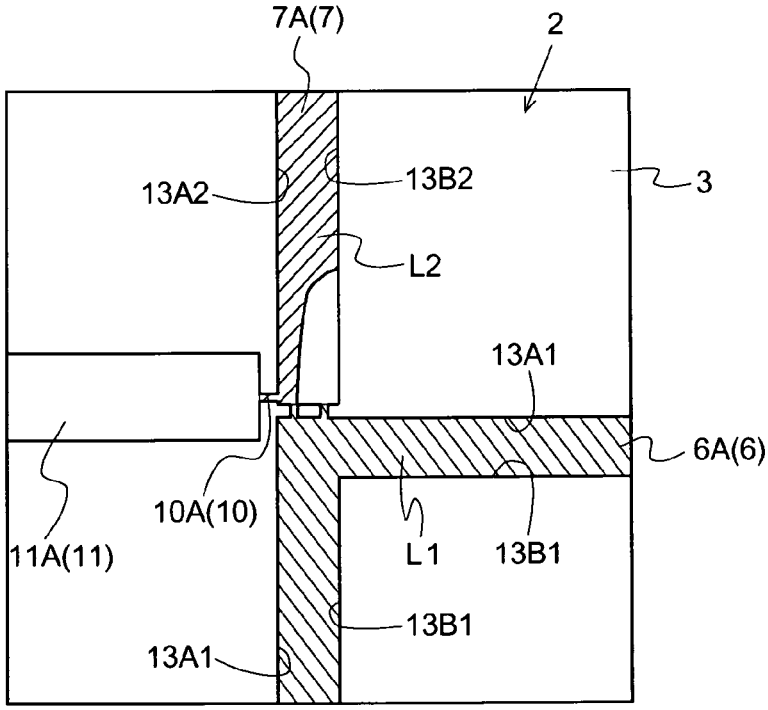
FIG. 5 is an illustration showing a first example of the ununiform flow of a liquid in a second groove (a second flow passage)
Figure 6:
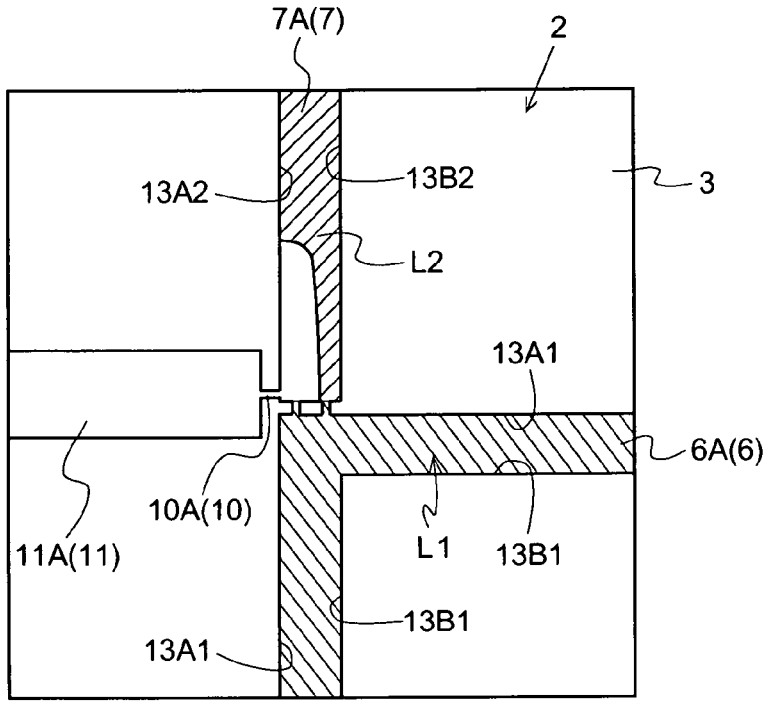
FIG. 6 is an illustration showing a second example of the ununiform flow of a liquid in a second groove (a second flow passage)
Figure 7:
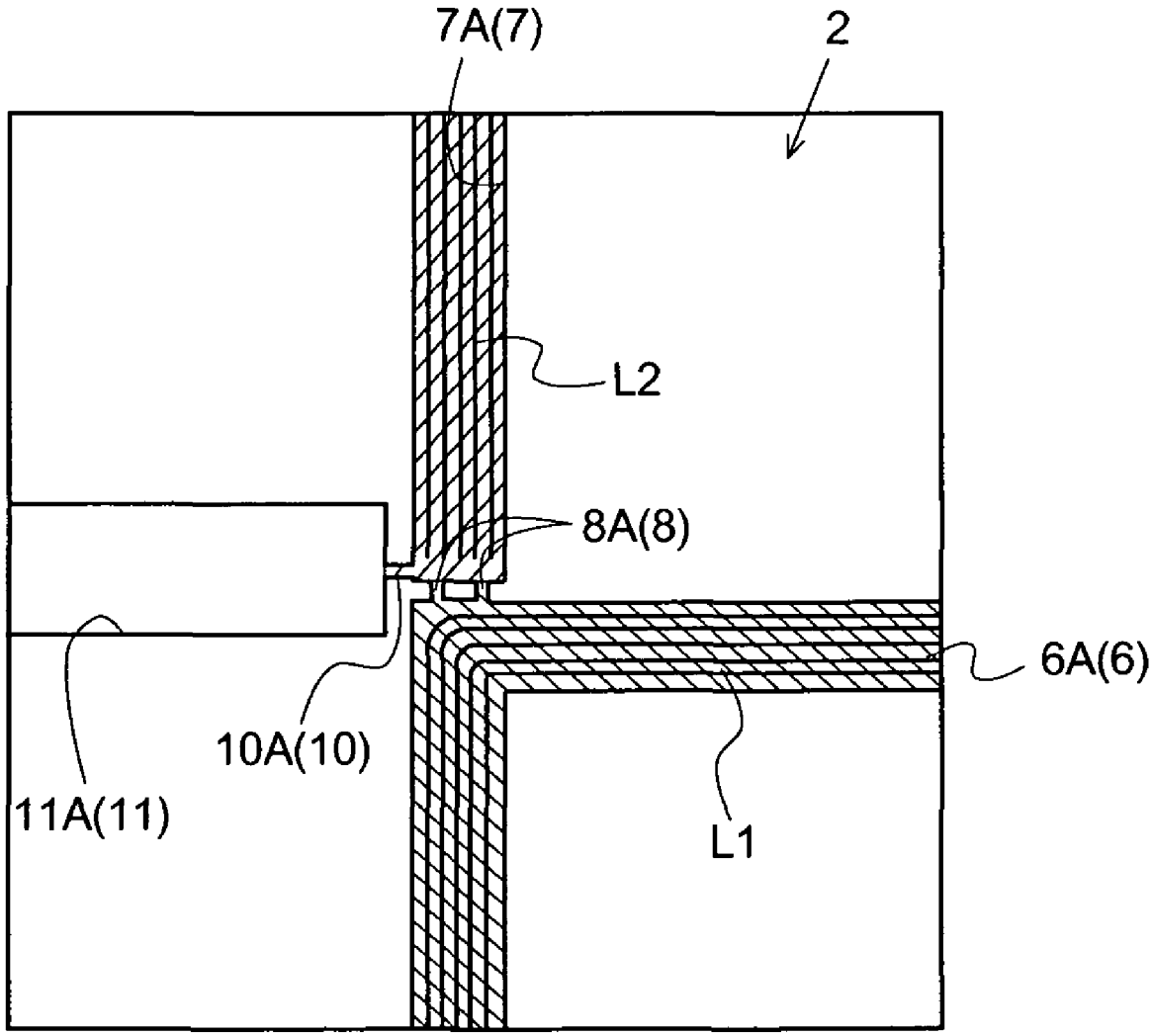
FIG. 7 is an illustration showing the uniform flow of a liquid in the first preferred embodiment of a fluid handling apparatus according to the present invention.

If the first groove 6A and second groove 7A having the rectangular cross section are formed by photolithography in the surface 3 of the first member 2 of the fluid handling apparatus 1 with this construction, there are some cases where both side faces (flow passage wall surfaces) 13A1, 13B1, 13A2 and 13B2 of the grooves 6A and 7A may be rougher than the bottoms (flow passage wall surfaces) 21 of the grooves 6A and 7A, so that wettability is unbalanced between one side face 13A1, 13A2 of the side faces 13A1, 13B1, 13A2, 13B2 of each of the grooves 6A and 7A and the other side face 13B1, 13B2 thereof (see FIGS. 5 and 6). As a result, for example, in the second groove 7A, the wettability to the liquid L2 (shown by slanting lines) may be unbalanced between the side face 13A2 and the side face 13B2, so that the liquid L2 on the side of the one side face 13A2 may flow at a higher rate than the liquid L2 on the side of the other side face 13B2 as shown in FIG. 5. Alternatively, the liquid L2 on the side of the other side face 13B2 may flow at a higher rate than the liquid L2 on the side of the one side face 13A2. In such cases, gas in the second flow passage 7 is exhausted to the external environment via the fourth flow passage 10 and external environment communication passage 11 in the case of FIG. 6. However, in the case of FIG. 5, the first flow passage 6 is closed by the first liquid (first fluid) L1, and the fourth flow passage 10 is also closed by the second liquid (second fluid) L2, so that there is the possibility that gas in the second flow passage 7 can not effectively be exhausted to the external environment. However, in the fluid handling apparatus 1 in this preferred embodiment, the plurality of micro protrusions 22 or plurality of micro grooves 23 are formed on or in the bottom 21 of the groove (see FIGS. 3A through 3D and 4) to improve the wettability of the bottom 21 in comparison with the both side faces 13A1, 13B1, 13A2, 13B2, so that it is possible to uniform the function of capillarity (the flow of the liquids L1 and L2) on the cross section of the flow passage in the first groove 6A (first flow passage 6) and second groove 7A (second flow passage 7) without being greatly influenced by both side faces 13A1, 13B1, 13A2, 13B2 (see FIG. 7). In addition, in the fluid handling apparatus 1 in this preferred embodiment, the second flow passage 7 has the fluid movement suppressing portion (flat surface 221) between the communication portion 12 and the upstream portion (in the flow direction of the fluid) of the opening portion of the fourth flow passage 10 to the second flow passage 7, so that it is possible to suppress the movement of the fluid in the second flow passage 7 on the side of the wall surface in which the fluid movement suppressing portion is formed.

The second liquid L2 flowing in the second flow passage 7 due to capillarity is balanced in lateral directions (on the sides of the side faces 13A2 and 13B2) by the capillarity promoting portion 220 (or the capillarity promoting portion 230) formed upstream of the fluid movement suppressing portion (flat surface 221) while gas in the second flow passage 7 is driven by the traveling end face of the liquid L2 in the downstream direction. Then, when the second liquid L2 reaches the fluid movement suppressing portion 221 which is formed downstream of the capillarity promoting portion 220 before the downstream end of the second flow passage 7 in front of the fourth flow passage 10 (upstream of the fourth flow passage 10 in the flow of the liquid L2) communicated with the external environment (the external environment communication passage 11), the flow of the second liquid L2 is suppressed by the fluid movement suppressing portion 221, so that the second liquid L2 is prevented from being introduced into the external environment communication passage 11 prior to gas. Therefore, after gas driven by the traveling end face of the liquid L2 into the second flow passage 7 is exhausted, the second liquid L2 enters the fourth flow passage 10 due to capillarity. At this time, the second liquid L2 entering the fourth flow passage 10 is dammed at the open end of the fourth flow passage 10 on the side of the external environment communication passage 11 so as not to leak toward to the external environment communication passage 11, since the angle between the fourth flow passage 10 and the end portion 15 of the external environment communication passage 11 (the external communication groove 11A) is the right angle so that the flow passage area of the fourth flow passage 10 at the open end on the side of the external environment is abruptly increased to cause a capillary repulsive force. Thus, gas remains in the second flow passage 7, so that bubbles are not mixed with the second liquid L2 in the second flow passage 7. Furthermore, the open end of the fourth passage 10 on the side of the second flow passage 7 is a communication portion which allows gas to leak to the external environment, and the open end of the fourth passage 10 on the side of the external environment communication passage 11 is a portion in which a capillary repulsive force acts.

As described above, in the fluid handling apparatus 1 in this preferred embodiment, as shown in FIGS. 1A, 1B, 4 and 7, if the first liquid (first fluid) L1 is fed into the first flow passage 6 from the first port 24, the first liquid L1 flows toward the second port 25 in the first flow passage 6 due to capillarity, and a part of the first liquid L1 enters the third flow passage 8 due to capillarity. At this time, the first liquid L1 entering the third flow passage 8 is dammed at the open end of the third flow passage 8 on the side of the second flow passage 7, since the angle between the end portion 14 of the second flow passage 7 and the third flow passage 8 is the right angle so that a capillary repulsive force acts at the open end of the third flow passage 8 on the side of the second flow passage 7. Then, the second liquid L2 fed into the second flow passage 7 from the third port 26 flows toward the communication portion 12 (the third flow passage 8) in the second flow passage 7 due to capillarity. At this time, gas in the second flow passage 7 is exhausted to the external environment via the fourth flow passage 10 and external environment communication passage 11 by the second liquid L2 flowing in the second flow passage 7. As a result, the second liquid L2 surely flows to the end portion 14 of the second flow passage 7 due to capillarity to form a liquid-liquid interface level between the second liquid L2 and the first liquid L1 arranged at the open end of the third flow passage 8 on the side of the second flow passage 7.

Furthermore, if the second liquid L2 fed into the second flow passage 7 reaches the third flow passage 8 prior to the first liquid L1 in the first flow passage 6, the second liquid L2 enters the third flow passage 8 due to capillarity. At this time, the second liquid L2 entering the third flow passage 8 is dammed at the open end of the third flow passage 8 on the side of the first flow passage 6, since the angle between the side face 13A1 of the first flow passage 6 and the third flow passage 8 is the right angle so that a capillary repulsive force acts at the open end of the third flow passage 8 on the side of the first flow passage 6. As a result, the second liquid L2 positioned at the open end of the third flow passage 8 on the side of the first flow passage 6 forms a liquid-liquid interface level between the second liquid L2 and the first liquid L1 flowing in the first flow passage 6 due to capillarity. In such a case, if the capillarity promoting portion 220 or 230 in the second flow passage 7 is extended (formed) to the end portion of the third flow passage 8, there is the possibility that the liquid stop function in the third flow passage 8 may be damaged. Therefore, as shown in FIG. 4, the end portion of the capillarity promoting portion 220 or 230 is formed so as to be apart from the end portion of the third flow passage 8.

According to the fluid handling apparatus 1 with such a construction, it is possible to easily form a liquid-liquid interface level by the movement of the first liquid L1 and second liquid L2 utilizing capillarity without mixing bubbles in the first liquid L1 in the first flow passage 6 and in the second liquid L2 in the second flow passage 7. Therefore, according to the fluid handling apparatus 1 in this preferred embodiment, it is not required to provide any valve structures which are open and closed by pressure when a liquid-liquid interface level is formed, so that it is possible to simplify the structure of the apparatus and to miniaturize the whole apparatus.

While the micro protrusions 22 or micro grooves 23 have been formed on or in the bottom 21 of each of the first groove 6A (the first flow passage 6) and the second groove 7A (the second flow passage 7), the present invention should not be limited thereto, but the micro protrusions 22 or micro grooves 23 may be formed on or in suitable portions, in which wettability is to be improved, in order to balance capillarity in the first flow passage 6 and second flow passage 7.

While the capillarity promoting portion 220 has been formed by the plurality of micro protrusions 22 or the capillarity promoting portion 230 has been formed by the plurality of micro grooves 23 in this preferred embodiment, the present invention should not be limited thereto. The surface of the bottom 21 of each of the first and second grooves 6A and 7A may be a satin finished surface or a roughened surface so that the flow of each of the first and second liquids L1 and L2 in the first and second flow passages 6 and 7 is uniform on the cross section of the flow passage.

Strictly speaking, since the properties (wettability to a fluid) of the bottom 21, side faces 13A1, 13B1 and side faces 13A2, 13B2 forming the first and second flow passages 6 and 7, and the reverse 5 of the second member 4 are different, the contact angle of the fluid with respect to each of the wall surfaces of the flow passages is different. Therefore, the traveling end face of the fluid near the wall surfaces of the flow passages is not consistent with a plane parallel to a perpendicular plane to the flow direction of the fluid (the traveling end face is not uniform on the cross section of the flow passage, i.e., the traveling end face contacting the bottom 21 having a high wettability is easy to be convex toward downstream, and the traveling end face contacting a surface having a low wettability is easy to be concave toward downstream). However, the traveling end face of the fluid as a whole is controlled so as to be slightly inclined with respect to the plane parallel to the plane perpendicular to the flow direction of the fluid.

While the capillary attractive force has been improved by forming the micro protrusions 22 or micro grooves 23 parallel to the flow of the fluid in the first and second flow passages 6 and 7 in this preferred embodiment, the micro protrusions 22 or micro grooves 23 may be formed so as to be perpendicular to the flow of the fluid in portions in which the capillary attractive force is to be suppressed. For example, in this preferred embodiment, if the second liquid L2 enters the third flow passage 8 prior to the first liquid L1, micro protrusions or micro grooves perpendicular to the flow direction of the second liquid L2 may be formed in the end portion of the third flow passage 8 on the side of the second flow passage 7 to weaken the capillary attractive force acting on the second liquid L2.

While the micro protrusions 22 or micro grooves 23 have been formed at regular intervals in this preferred embodiment, the present invention should not be limited thereto, but the micro protrusions 22 or micro grooves 23 may be formed at irregular intervals.

In this preferred embodiment, if the first liquid L1 is injected into the first flow passage 6 after the second liquid L2 injected into the second flow passage 7 enters the third flow passage 8, and if the second port 25 is communicated with the external environment, the fourth flow passage 10 and external environment communication passage 11 may be omitted.

Second Preferred Embodiment

Figure 8A:
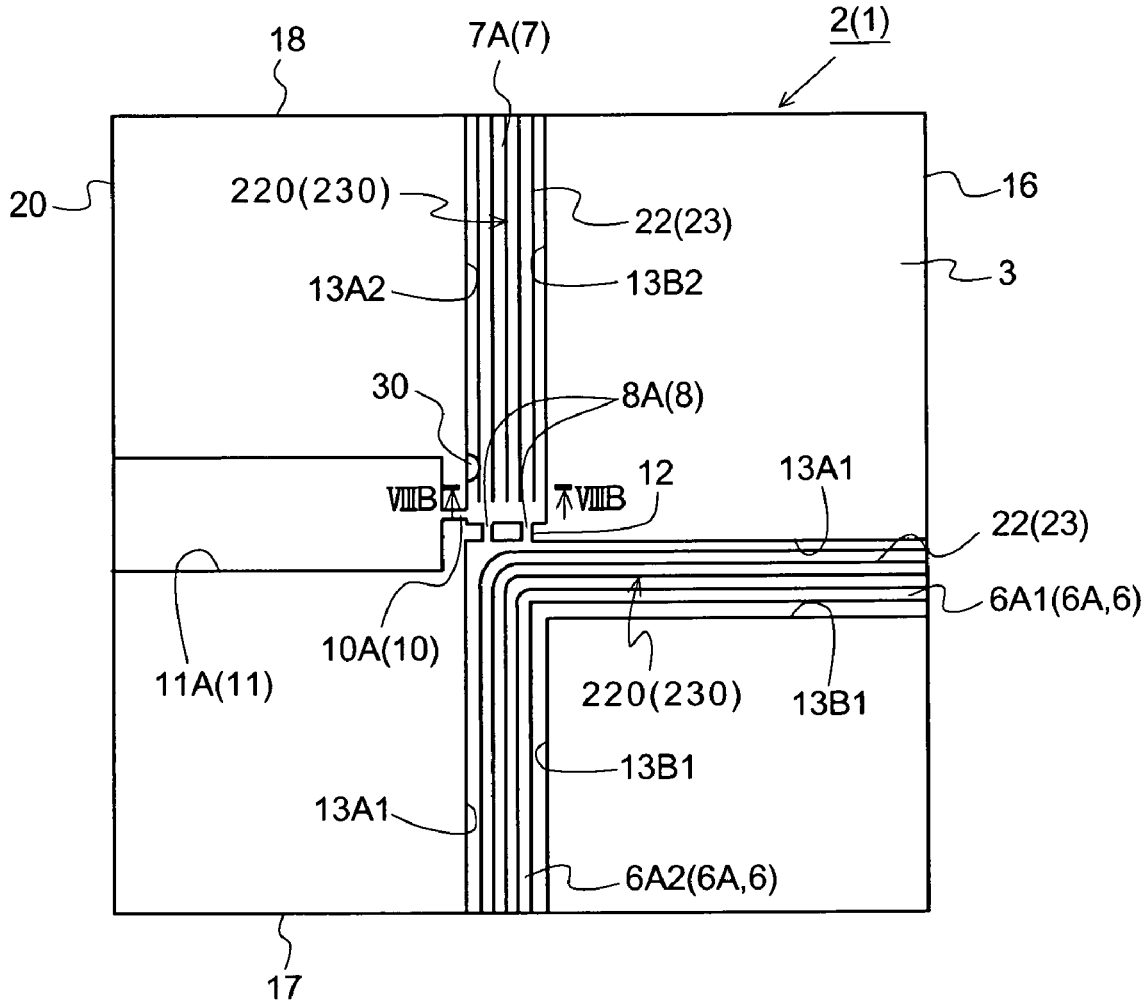
FIG. 8A is a plan view of a first member of the second preferred embodiment of a fluid handling apparatus according to the present invention.
Figure 8B:
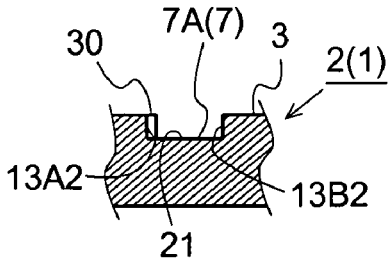
FIG. 8B is a sectional view taken along line VIIIB-VIIIB of FIG. 8A.

FIGS. 8A and 8B show the second preferred embodiment of a fluid handling apparatus according to the present invention. The fluid handling apparatus 1 in this preferred embodiment has the same basic structure as that of the fluid handling apparatus 1 in the first preferred embodiment, except for the structure of the second flow passage 7. Therefore, the same reference numbers are given to the same structural portions as those of the fluid handling apparatus 1 in the first preferred embodiment to omit the duplicate descriptions thereof.

Figure 9:
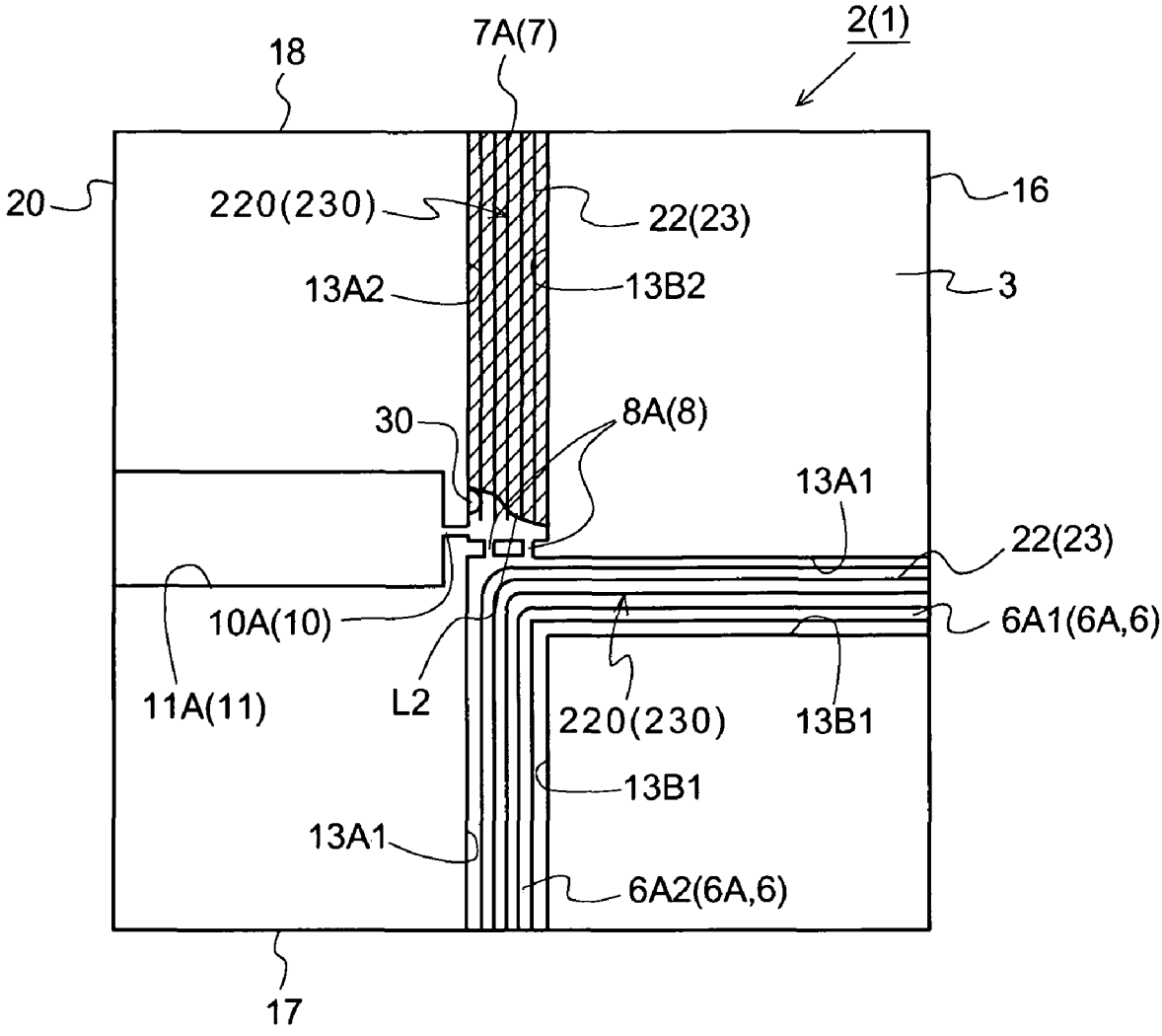
FIG. 9 is an illustration showing the flow of a liquid in a second flow passage of the second preferred embodiment of a fluid handling apparatus according to the present invention.

In this preferred embodiment, on the side face 13A2 which is one of the side faces of the second groove 7A (the second flow passage 7) and in which the fourth groove 10A (the fourth flow passage 10) is open, a protrusion (a fluid movement suppressing portion) 30 protruding in the second flow passage 7 for suppressing the movement of the second liquid L2 is formed in the vicinity and upstream of the opening portion of the fourth flow passage 10 (on the upper side in FIG. 8A and on the opposite side to the third flow passage 8). The protrusion 30 has a semicircular shape, which extends along the one side face 13A2 from the bottom 21 of the second flow passage 7 to the surface 3 thereof, for inhibiting the flow of the second liquid L2 along the side face 13A2 in which the fourth flow passage 10 is open. As a result, the flow of the second liquid L2 traveling on the side of the other side face 13B in the second flow passage 7 due to capillarity is prior to the flow of the second liquid L2 traveling on the side of the one side face 13A2, so that the front end face of the traveling second liquid L2 is inclined to lower right from the one side face 13A2 toward the other side face 13B2 as shown in FIG. 9. Thus, gas in the second flow passage 7 can be more surely led into the fourth flow passage 10 than the first preferred embodiment.

While the planar shape of the protrusion 30 has been semicircular in this preferred embodiment, the present invention should not be limited thereto, but the planar shape of the protrusion 30 may be rectangular, triangular or trapezoidal.

While the protrusion 30 has been formed as the fluid movement suppressing portion in this preferred embodiment, the present invention should not be limited thereto, but a recessed portion for causing a resistance for preventing the flow of the second liquid L2 may be formed as the fluid movement suppressing portion.

Third Preferred Embodiment

Figure 10:
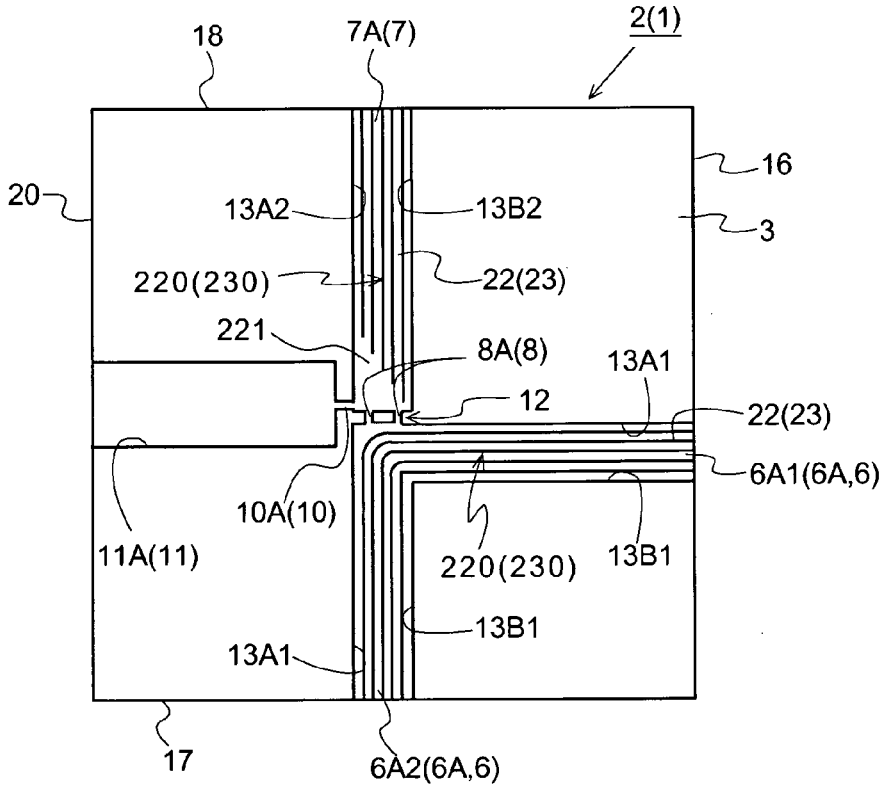
FIG. 10 is a plan view of a first member of the third preferred embodiment of a fluid handling apparatus according to the present invention.

FIG. 10 shows the third preferred embodiment of a fluid handling apparatus according to the present invention. The fluid handling apparatus 1 in this preferred embodiment has the same basic structure as that of the fluid handling apparatus 1 in the first preferred embodiment, except for the structure of the second flow passage 7. Therefore, the same reference numbers are given to the same structural portions as those of the fluid handling apparatus 1 in the first preferred embodiment to omit the duplicate descriptions thereof.

In this preferred embodiment, the downstream end portions of the micro protrusions 22 or micro grooves 23 formed on or in the bottom 21 of the second groove 7A (the second flow passage 7) (the lower end portions of the micro protrusions 22 or micro grooves 23 in the figure) are arranged at lower positions to lower right from the side face 13A2 of the second groove 7A in the vicinity and upstream (on the upper side in the figure) of the opening portion of the fourth flow passage 10 toward the other side face 13B2. Thus, the plurality of micro protrusion 22 or micro grooves 23 form a capillarity promoting portion 220 or 230. The second groove 7A (the second flow passage 7) has a flat surface (a fluid movement suppressing portion) 221 downstream of the capillarity promoting portion 220 or 230 in the flow direction of the second liquid L2 (on the side of the third flow passage 8).

Figure 11:
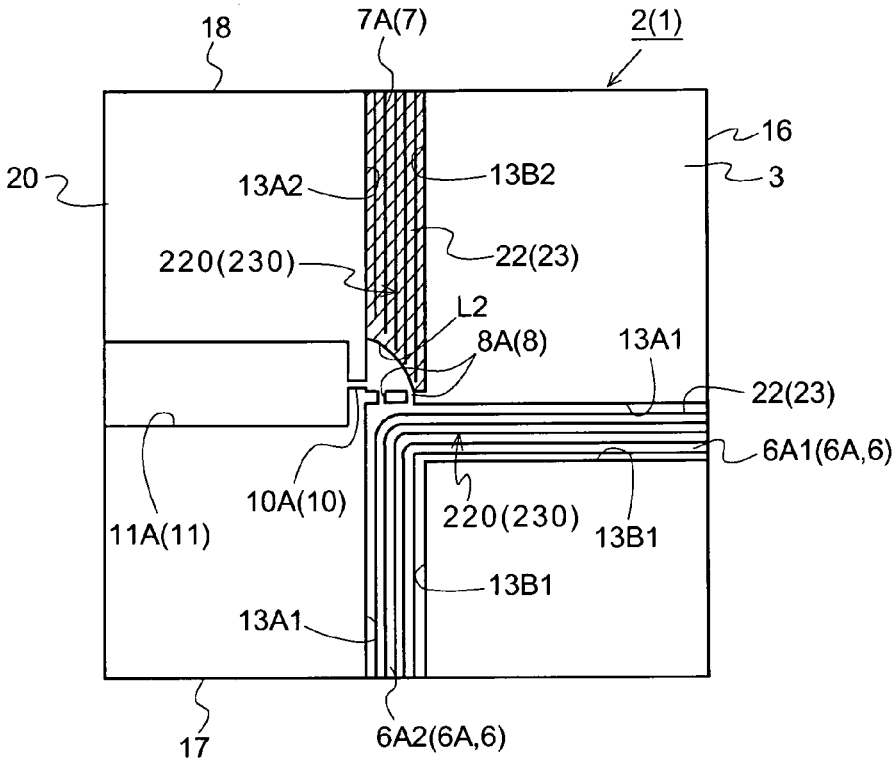
FIG. 11 is an illustration showing the flow of a liquid in a second flow passage of the third preferred embodiment of a fluid handling apparatus according to the present invention.

If the plurality of micro protrusions 22 or micro grooves 23 are thus formed, capillarity more greatly acts on the second liquid L2 in the second flow passage 7 on the side of the other side face 13B2 than the one side face 13A2. As a result, as shown in FIG. 11, the second liquid L2 in the second flow passage 7 on the side of the other side face 13B2 travels prior to that on the side of the one side face 13A2, so that the front end face of the traveling second liquid L2 is inclined downwards from the one side face 13A2 toward the other side face 13B2. Thus, gas in the second flow passage 7 can be more surely led into the fourth flow passage 10 than the first preferred embodiment.

Fourth Preferred Embodiment

Figure 12A:
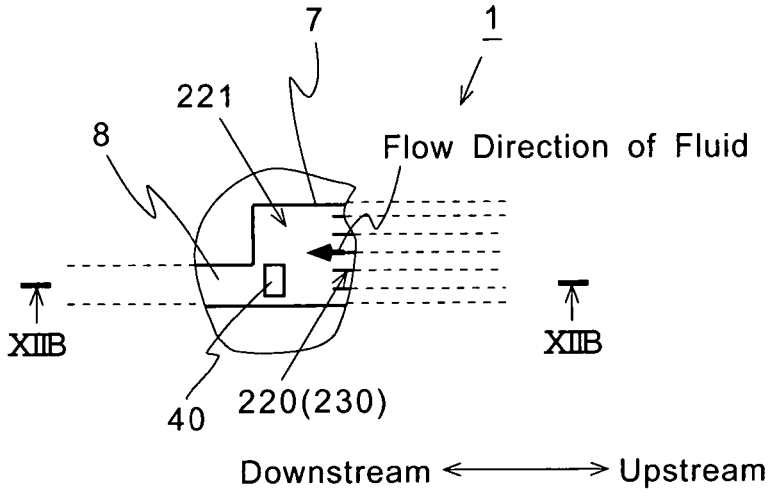
FIG. 12A is a plan view showing a part of a second member of the fourth preferred embodiment of a fluid handling apparatus according to the present invention.
Figure 12B:
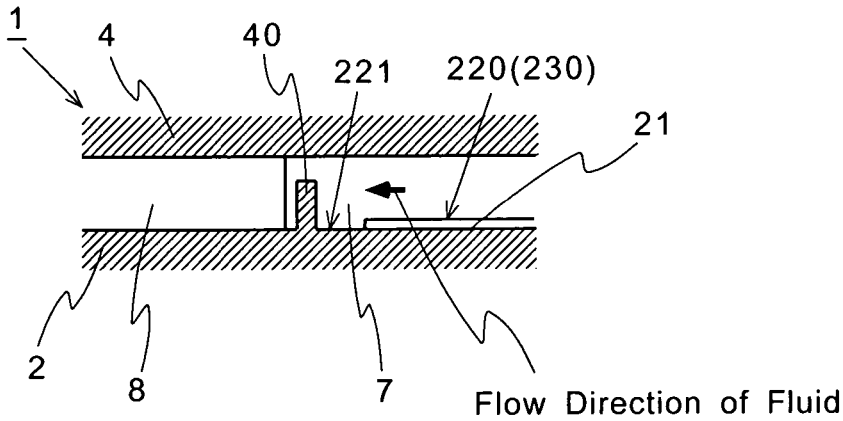
FIG. 12B is a sectional view taken along line XIIB-XIIB of FIG. 12A.

FIGS. 12A and 12B show the fourth preferred embodiment of a fluid handling apparatus 1 according to the present invention. FIG. 12A is a plan view showing a part of a second member 4 of the fluid handling apparatus 1, and FIG. 12B is a cross section taken along line XIIB-XIIB of FIG. 12A. Furthermore, in FIGS. 12A and 12B, the same reference numbers are given to the same structural portions as those in each of the above described preferred embodiments to omit the duplicate descriptions thereof.

As shown in FIGS. 12A and 12B, in the fluid handling apparatus 1 in this preferred embodiment, the downstream end of a second flow passage 7 is connected to a third flow passage 8 having a smaller flow passage area than that of the second flow passage 7. A protrusion (a fluid movement suppressing portion) 40 for suppressing the movement of a fluid is formed so as to protrude from the bottom 21 in the second flow passage 7 in the vicinity and upstream of the opening portion (a predetermined region) of the third flow passage 8 on the side of the second flow passage 7. Furthermore, the opening portion of the third flow passage 8 on one end side thereof (not shown), which is opposite to the opening portion thereof on the side of the second flow passage 7 (on the other end side), is connected to another flow passage, the flow passage area of which abruptly increases, or the external environment, so that a capillary repulsive force acts thereon by the opening portion on the other end side.

In this preferred embodiment with such a construction, the flow of a fluid traveling in the second flow passage 7 due to capillarity is uniformed by the capillarity promoting portion 220 (or 230), and the movement of the fluid traveling in the second flow passage 7 is suppressed by the flat surface (the fluid movement suppressing portion) 221 and the protrusions (the fluid movement suppressing portion) 40, so that gas driven by the traveling end face of the fluid can be extruded from the second flow passage 7 to the third flow passage 8. As a result, it is possible to prevent gas from remaining in the second flow passage 7. Furthermore, while the shape of each of the protrusions 40 has been a rectangular parallelepiped in this preferred embodiment, the present invention should not be limited thereto, but it may be a semicircle or any one of other shapes.

Other Preferred Embodiment

The present invention should not be limited to the above described preferred embodiments wherein the first through fourth grooves 6A, 7A, 8A, 10A and the external communication groove 11A are formed in the surface 3 of the first member 2. The first through fourth flow passages 6 through 8, 10 and the external environment communication passage 11 may be formed by causing the surface 3 of the first member 2, which has any one or some of the first through fourth grooves 6A, 7A, 8A, 10A and the external communication groove 11A, to adhere to the reverse 5 of the second member 4 which has the other groove(s). Alternatively, the first through fourth flow passages 6 through 8, 10 and the external environment communication passage 11 may be formed in the first and second members 2 and 4 so as to be divided between the first and second members 2 and 4 by causing the surface 3 of the first member 2 to adhere to the reverse 5 of the second member 4, the first through fourth grooves 6A, 7A, 8A, 10A and the external communication groove 11A being formed in the surface 3 of the first member 2 and the reverse 5 of the second member 4 so as to be divided between the surface 3 of the first member 2 and the reverse 5 of the second member 4.

In each of the above described preferred embodiments, the capillarity promoting portion 220 or 230 may be formed in the reverse 5 of the second member 4 so as to correspond to the first groove 6A and second groove 7A.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A fluid handling apparatus comprising:

a flow passage for allowing a fluid to move therein due to capillarity; and a communication portion for establishing a fluid communication between said flow passage and an external environment, wherein said flow passage has a bottom face which has a flat surface portion serving as a fluid movement suppressing portion for suppressing the movement of the fluid in said flow passage due to capillarity, at least a part of the fluid movement suppressing portion being formed upstream of said communication portion, and said bottom face of the flow passage has a plurality of fine grooves or fine protruding portions which extend in longitudinal directions thereof to serve as a capillarity promoting portion for allowing the uniform movement of the fluid in said flow passage, at least a part of the capillarity promoting portion being formed upstream of said fluid movement suppressing portion.

2. A fluid handling apparatus as set forth in claim 1, wherein said fluid movement suppressing portion has a protrusion formed so as to suppress the movement of the fluid in said flow passage.

3. A fluid handling apparatus as set forth in claim 1, wherein said communication portion is narrower than said flow passage.

4. A fluid handling apparatus comprising:

a first flow passage for allowing a fluid to move therein due to capillarity;

a second flow passage for allowing a fluid to move therein due to capillarity;

a first communication portion for establishing a fluid communication between said first and second flow passages; and a second communication portion for establishing a fluid communication between said second flow passage and an external environment, wherein said second flow passage has a bottom face which has a flat surface portion serving as a fluid movement suppressing portion for suppressing the movement of the fluid in said second flow passage due to capillarity, at least a part of the fluid movement suppressing portion being formed upstream of said first and second communication portions, and said bottom face of the second flow passage has a plurality of fine grooves or fine protruding portions which extend in longitudinal directions thereof to serve as a capillarity promoting portion for allowing the uniform movement of the fluid in said second flow passage, at least a part of the capillarity promoting portion being formed upstream of said fluid movement suppressing portion.

5. A fluid handling apparatus as set forth in claim 4, wherein said fluid movement suppressing portion has a protrusion formed so as to suppress the movement of the fluid in said second flow passage.

6. A fluid handling apparatus as set forth in claim 4, wherein each of said first and second communication portions is narrower than each of said first and second flow passages.

* * * * *